US005904263A

United States Patent [19]

St. Pierre et al.

[11] Patent Number: 5,904,263

[45] Date of Patent: May 18, 1999

[54] MULTI-CONTAINER PACKAGE WITH INDIVIDUALLY REMOVABLE CONTAINERS

[75] Inventors: Dane T. St. Pierre, Cornwall; Kevin J. Gosling, Longsault, both of Canada

[73] Assignee: Kraft Canada Inc., Don Mills, Canada

[21] Appl. No.: 08/978,017

[22] Filed: Nov. 25, 1997

[51] Int. Cl.[6] ..... B65D 21/02

[52] U.S. Cl. ..... 220/23.4; 220/359.2; 220/359.4

[58] Field of Search ..... 220/23.4, 359.2, 220/359.4

[56] References Cited

U.S. PATENT DOCUMENTS

| | | | |
|---|---|---|---|
| 2,984,346 | 5/1961 | Holley | 220/23.4 |
| 3,021,001 | 2/1962 | Donofrio | 220/23.4 |
| 3,054,679 | 9/1962 | Bradford | 220/23.4 X |
| 3,145,112 | 8/1964 | Boegershausen . | |
| 3,983,999 | 10/1976 | Morton . | |
| 4,054,207 | 10/1977 | Lazure et al. | 220/23.4 X |
| 4,736,841 | 4/1988 | Kaneko et al. | 220/359.4 X |
| 4,875,620 | 10/1989 | Lane, Sr. | 220/23.4 X |
| 4,901,505 | 2/1990 | Williams, Jr. . | |
| 5,503,856 | 4/1996 | Hustad et al. . | |

*Primary Examiner*—Stephen K. Cronin
*Attorney, Agent, or Firm*—Thomas A. Marcoux; Thomas R. Savoie

[57] ABSTRACT

A multi-container package includes several individually sealed containers which are easily separable from one another by weakened zones between adjacent containers. Each container includes a tab portion over which the peel tab of the lid extends. Dimples in either the peel tab or tab portion facilitate their separation. Several multi-container packages are manufactured as a unit using a die and conventional heat sealing processes, and then are separated from one another by transverse cuts.

12 Claims, 2 Drawing Sheets

MULTI-CONTAINER PACKAGE WITH INDIVIDUALLY REMOVABLE CONTAINERS

FIELD OF THE INVENTION

The present invention relates to a multi-container package wherein each of the containers is individually sealed and removable from the remainder of the package in the sealed condition, and a method of manufacture therefor.

BACKGROUND OF THE INVENTION

In general, the cost of purchasing a food item packaged in bulk tends to be much less expensive in terms of price per unit weight than the cost of purchasing a small quantity of the same food item, such as a single serving size. Further, a new industry trend is the discount food chain which offers food items sold only in bulk quantities, but at an even lower cost than that offered in conventional grocery stores.

Many of the food items which are sold in bulk quantities have a prolonged shelf life of several months if they are kept in a sealed container. However, once the container is opened, such items may spoil after one week or less. Thus, although the purchase of food items in bulk quantities provides a financial benefit to larger households, schools, small restaurants and the like, individuals, or households with only a few members are unable to derive any benefit from the lower cost since the food item, once opened, may spoil before the purchaser is able to finish the entire package/container. Such spoilage could be avoided if the bulk quantity of the food item were separated into smaller serving sizes which were each individually sealed.

One example of a package which includes several separately sealed sections is disclosed in U.S. Pat. No. 5,503,856 to Hustad et al. Another example of a food package containing multiple compartments is disclosed in U.S. Pat. No. 3,983,999 to Morton. The Morton package is designed to hold individual quantities of frozen orange juice, which may be individually separated from the remainder of the package. However, neither the Hustad et al nor the Morton multi-container packages are designed to retain a tight seal, yet allow easy opening when desired.

SUMMARY OF THE INVENTION

Thus, it is a purpose of the present invention to provide a new and improved multi-container package in which the containers are individually separable, remain tightly sealed until opened and include a means for easy opening when desired. This purpose is achieved by providing a package including at least two containers. Each of the containers includes a receptacle having a closed bottom, side walls and an open top. The receptacles are joined together by a frame extending completely around their upper perimeters. A removable lid is sealed to the frame around the tops of each of the receptacles. The removable lid and frame include corresponding weakened zones between adjacent containers for ease of separation of individual, sealed containers from the package. The frame includes tab portions extending outwardly from each of the containers. Peel tabs on the lid correspond to each of the tab portions. Only the peel tabs and tab portions must be grasped to open the individual containers, thereby reducing the chances of deformation to the container and its contents.

In accordance with a preferred embodiment of the invention, dimples are positioned on either the tab portions or on the peel tabs for ease in separating the peel tabs from the tab portions. Preferably, the package consists of a single row of several containers attached along adjacent sides, both the containers and package having a rectangular shape. Further, the package is preferably constructed from flexible, transparent materials.

It is also a purpose of the present invention to provide a method of manufacturing a multi-container package. According to the method, a film is placed over a bottom die having pockets therein, the film being shaped in the same form as the pockets by heating and applying a vacuum to form receptacles. A product is then added to the receptacles, and a top film is placed over the receptacles. The resultant containers are then evacuated and the top film is heat sealed to the bottom film, the top film thereby forming a lid for the containers. A weakened zone between the containers is created by perforations, scoring, or the like such that individual containers are easily separated from the multi-container package. Preferably, several rows of containers are formed in the process, and then each of the rows separated from an adjacent row by transverse cuts in the top and bottom films.

It is, therefore, an object of the present invention to provide an improved multi-container package wherein individual containers are easily removed from the package, both a single removed container and the remainder of the package remaining sealed.

It is a further object of the invention to provide a multi-container package wherein the individual containers are easily opened by means of a lid having a peel tab which is easily grasped and pulled away from the container to expose the contents thereof.

It is another object of the invention to provide a method of manufacturing a multi-container package wherein the size of the individual containers is easily adjusted.

These and other objects of the present invention will become apparent from the detailed description to follow.

BRIEF DESCRIPTION OF THE DRAWINGS

There follows a detailed description of the preferred embodiments of the invention which are to be taken together with the accompanying drawings, wherein.

DESCRIPTION OF THE PREFERRED EMBODIMENTS

Referring now to the figures, like elements are represented by like numerals throughout the several views.

Figure 1:
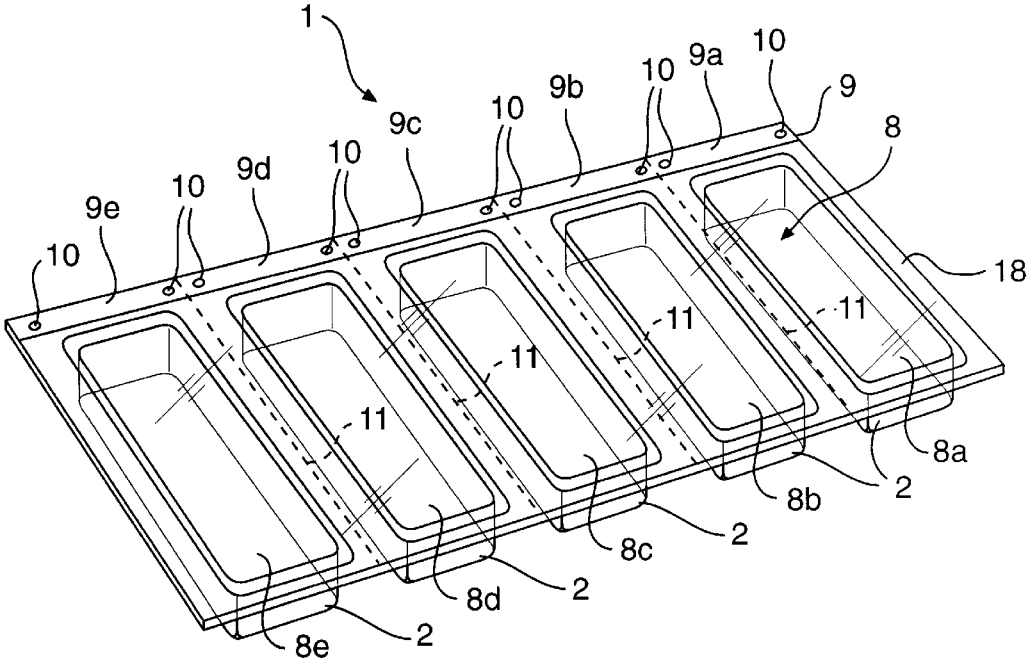
FIG. 1 is a perspective view of a multi-container package according to the invention.

FIG. 1 shows a multi-container package 1 including five individual containers 2. As shown more clearly in FIG. 2, each individual container 2 includes a receptacle 3 having a closed bottom 4', side walls 4 and an open top 5. A frame 6 extends completely around the top perimeter of each of the individual receptacles 3 and is connected to the upper edges of the side walls 4. The frame 6 includes tab portions 7 which extend outwardly from at least one side wall of each of the receptacles 3. The tab portion 7 may extend outwardly from any of the side walls 4 of the receptacles 3, the purpose of tab portion 7 being described in greater detail below.

Figure 2:
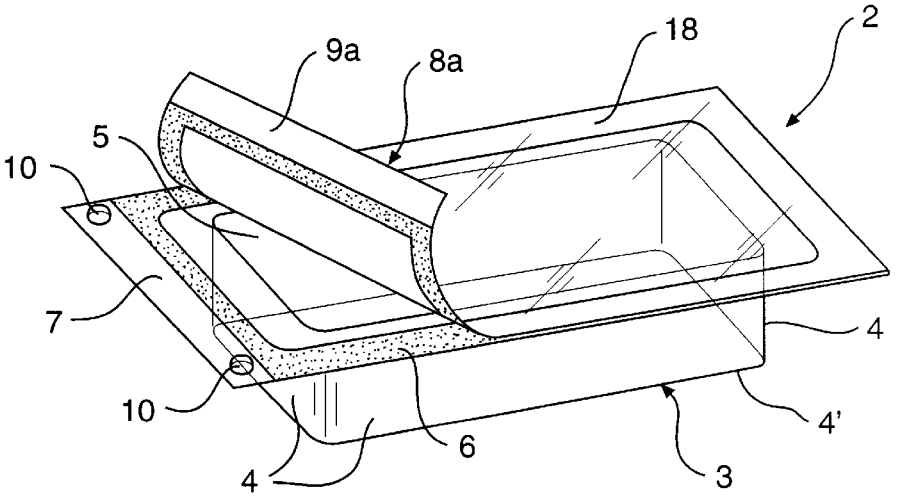
FIG. 2 is a perspective view of an individual container after removal from the package, the container being partially opened.

Referring to both FIGS. 1 and 2, a removable lid 8 is sealed to the frame 6 at areas 18 around the open tops 5 of each of the receptacles 3 to thereby completely seal each of the receptacles 3 to form individual containers 2. The lid 8 includes a peel tab 9. Upon removal of a container 2 from the multi-container package 1, as shown in FIG. 2, the peel tab 9*a* of the individual container 2 is easily separated from the frame 7 so that the lid 8*a* of the individual container 2 may be pulled away from the container 2 to expose the contents thereof. To even further facilitate separation of the peel tab 9*a* from the tab portion 7, dimples 10, in the form of raised notches, are positioned on the tab portion 7 so that the peel tab 9*a* and tab portion 7 always remain slightly separated and do not stick together. Although two dimples 10 per container 2 are shown, there may be any number of dimples utilized and, further, the dimples 10 may be positioned on the peel tab 9, rather than on the tab portion 7. The tab portion 7 is useful in that it provides an area for a user to grasp with one hand, while pulling the peel tab 9*a* with the other hand. Thus, the user need not grasp the side walls 4, potentially causing both the container 2 and contents thereof to be deformed.

The multi-container package 1 is preferably constructed from transparent materials to allow the contents to be viewed by the purchaser. Further, the multi-container package 1 is preferably constructed of relatively flexible materials. The individual containers 2 are separable from the remainder of the package 1 by weakened zones 11 located in the areas between adjacent containers 2. In general, these weakened zones 11 are formed by creating perforations, or score lines in the frame 6 and lid 8, thereby allowing the individual containers 2 to be easily separated from the remainder of the package 1 without damaging the seal extending around the frames of the individual containers 2.

The individual containers 2 preferably have a rectangular shape, although they may be constructed in various other shapes. For example, the multi-compartment container 1 could have a circular shape, with the individual containers being pie-shaped.

Figure 3:
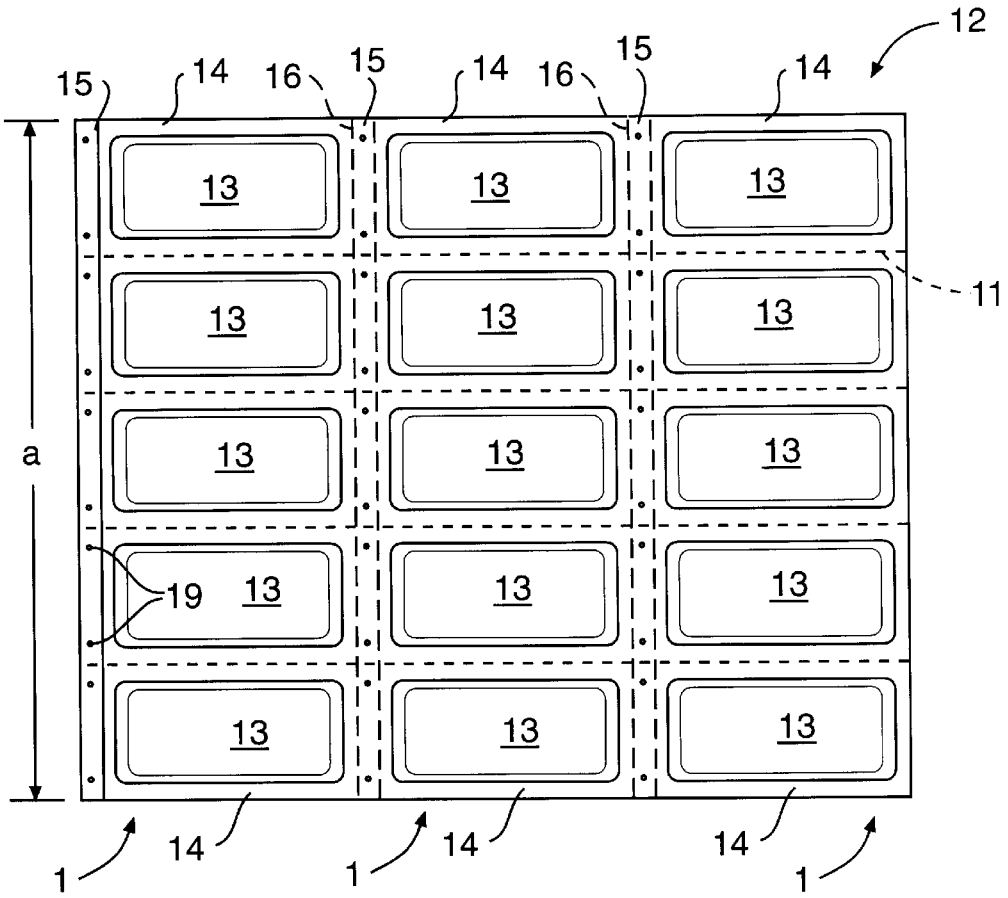
FIG. 3 is a top view of a die used to form several multi-container packages in accordance with the invention.

In the preferred method of manufacture, a die 12, shown in FIG. 3, having multiple pockets 13 is used to form the containers 2. A bottom film, preferably constructed of a flexible, but sturdy transparent material such as a co-extruded Nylon/Surlyn material, is heated to about 90° C.±5° C., depending on production rate, over the die 12. Air is used to blow down the bottom film which then takes the shape of pockets 13. Preferably, the shape of pockets 13 is rectangular as shown in FIGS. 1 and 2. Each pocket 13 forms the side walls 4 and an enclosed bottom 4', i.e., the receptacle 3 and areas 14 of the die 12 form the frame 6, such that each receptacle 3 and surrounding frame 6 are constructed from the same piece of material. Areas 15 are used to form tab portions 7 which are also part of the same piece of material.

After the bottom film is shaped to form the receptacle 3, frame 6 and tab portions 7, a product is placed in each of the individual receptacles 3. A top film is then placed over the die 12 to cover pockets 13 and outer areas 14,15. The top film should be slightly narrower than a length "a" of a row of pockets 13. The top film is preferably constructed from a Polyester/easy peel Surlyn material. The top and bottom films are pressed together between the bottom die 12 and a top die. Each of the containers' atmospheres is then evacuated and the top film is heat sealed to the bottom film around the tops of each of the receptacles through the application of pressure by the top die and bottom die 12, i.e., in areas 14 to completely seal the contents of each of the containers. The top and bottom films are not sealed in areas 15, thereby creating the peel tab 9 of the multi-container package 1. Moreover, it would also be possible to leave other areas unsealed, such as a section of the areas between individual containers to create peel tabs on more than one side. The dimples 10 are formed during the container-forming process by raised notches 19 in the die 12.

As shown, the die 12 is used to construct three multi-container packages 1 arranged longitudinally, each including five individual containers 2 arranged transversely. After the top and bottom films are sealed, the three individual multi-container packages 1 are separated by making transverse cuts along dotted lines 16 through both films. Further, weakened zones, represented by dotted lines 11, are formed between adjacent containers 2 by creating perforations, or score lines, which extend through the frame 6 and lid 8 to allow for ease of separation.

The individual containers may have any desired size. Further, the same die 12 may be used to construct smaller containers by placing a spacer (not shown) in the base of the pockets 13 prior to positioning the bottom film over the die 12. Such spacers have a rectangular shape and fill the bottom of the pockets 13, thereby simply creating a rectangular shaped container with a shortened depth.

In one use of the multi-container package of the invention, the individual containers are designed to hold bars of cheese, each bar weighing about 100 grams and equaling approximately one cup of cheese when shredded. Because different cheeses have different densities, different container sizes may be required. Thus, the spacers may be used to adjust container size depending on whether the packaged cheese is Mozzarella, Cheddar, etc. If only a slight change is required in container size, less heat and air pressure are applied to the bottom film so that it does not fully mold to the pockets, and the resultant receptacles 3 are slightly smaller than the size of the pockets 13. The amount of vacuum needed to evacuate each of the individual containers 2 should be just sufficient so that the top film forms a relatively flat lid, i.e., to eliminate any washboard effect.

Figure 4:
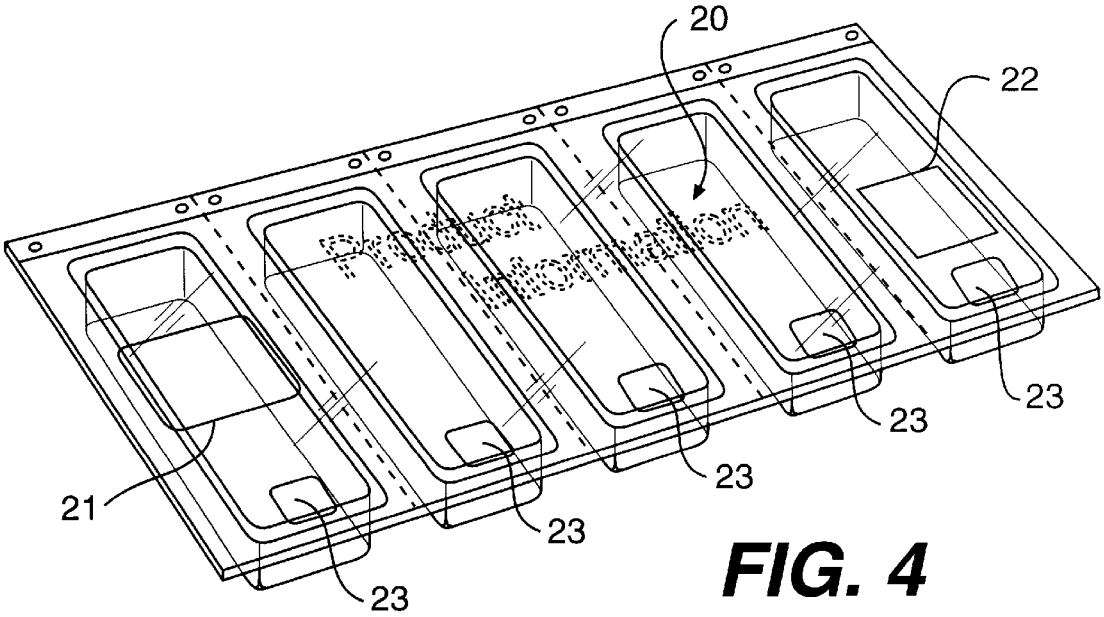
FIG. 4 is a perspective view similar to FIG. 1 with a lid including labeling information.

As shown in FIG. 4, the top film may include information regarding the package contents, etc. printed on it, thereby serving as a label. In the preferred embodiment, the package 1 is of a size sufficient to include all necessary labeling information on the lid 8. This is more convenient to the consumer who does not need to turn the package to read printing on more than one side. The manufacturing process is also less complex. Such labeling may, for example, include a section 20 for indicating the product brand and a general description of the package contents, a section 21 providing nutritional information, and a section 22 for providing bar-code information. Further, each individual container 2 may include information which is useful upon removal from the package 1. Such information would include an indication 23 of the weight or size, e.g., a 1 cup measure, of the container contents.

Although the invention has been described in considerable detail with respect to preferred embodiments thereof, variations and modifications will be apparent to those skilled in the art without departing from the spirit and scope of the invention as set forth in the claims.

We claim:

1. A multi-container package comprising at least two containers, each of said containers comprising:

a receptacle having a closed bottom, side walls, and an open top, and a frame extending completely around the top of each of said receptacles and connected to upper edges of said side walls, said frame including tab portions extending outwardly from at least one side wall of each said receptacles, said frame including weakened zones between adjacent receptacles; and a removable package lid sealed to said frame around respective open tops of each of said receptacles, said package lid being separable into individual lids each sealing a respective one of said receptacles, said package lid having weakened zones at points corresponding to said weakened zones in said frame, each of said individual lids including a peel tab covering one of said respective tab portions on said frame, each container having dimples positioned on one of said tab portions and said peel tabs, whereby a single, sealed container including a receptacle and its individual lid is removable from the package.

2. The package according to claim 1 wherein said package lid is heat sealed to said frame.

3. The package according to claim 1 wherein said package comprises flexible materials.

4. The package according to claim 1 wherein said package comprises transparent materials.

5. The package according to claim 1 wherein said weakened zones comprises perforations.

6. The package according to claim 1 wherein said frame and said receptacle are constructed from a single material piece.

7. The package according to claim 1 wherein said containers have a rectangular shape.

8. The package according to claim 7 comprising a single row of at least three containers attached along adjacent sides such that said package has a rectangular shape.

9. The package according to claim 8 wherein said tab portions extend outwardly along one side of said package.

10. A multi-container package comprising:

at least three containers, each of said containers comprising:

a rectangular-shaped receptacle with an open top and a frame extending completely around the open top of each of said receptacles, said frame including tab portions extending outwardly from at least one side wall of each of said receptacles, said frame including weakened zones between adjacent containers; and a removable lid having labeling information printed thereon, said lid being sealed to said frame around respective open tops of each of said receptacles, said lid being formed as a substantially flat surface and having weakened zones at points corresponding to said weakened zones in said frame including peel tabs covering respective tab portions on said frame, each container having dimples positioned on one of said tab portions and said peel tabs, whereby a single, sealed container, including its receptacle and lid, is removable from the package.

11. The package according to claim 10, including first labeling information relating to the contents of the entire package and further labeling information on and applicable to each individual container.

12. The package according to claim 10 comprising five containers.

* * * * *